US006394632B1

(12) United States Patent
Phillips et al.

(10) Patent No.: US 6,394,632 B1
(45) Date of Patent: May 28, 2002

(54) LAMP HAVING PULL CORD GUIDE DEVICE

(75) Inventors: Todd L. Phillips, Charleston; Thomas A. Garber, Mt. Pleasant, both of SC (US)

(73) Assignee: Quoizel, Inc., Goose Creek, SC (US)

( * ) Notice: Subject to any disclaimer, the term of this patent is extended or adjusted under 35 U.S.C. 154(b) by 0 days.

(21) Appl. No.: 09/653,634

(22) Filed: Sep. 1, 2000

(51) Int. Cl.[7] ..... F21S 8/08
(52) U.S. Cl. ..... 362/414; 362/394
(58) Field of Search ..... 362/394, 395, 362/410, 414; 200/331, 332

(56) References Cited

U.S. PATENT DOCUMENTS

| | | | | |
|---|---|---|---|---|
| 957,371 | A | | 5/1910 | Plunkett |
| 979,693 | A | | 12/1910 | Plunkett |
| 1,048,169 | A | | 12/1912 | Hubbell |
| 1,100,253 | A | | 6/1914 | Petit |
| 1,150,391 | A | * | 8/1915 | Sanford ..... 211/26 |
| 1,177,239 | A | | 3/1916 | Fitzgerald |
| 1,747,758 | A | | 2/1930 | Despard |
| 2,195,582 | A | | 4/1940 | Schoenberg |
| 2,382,823 | A | | 8/1945 | Schoenberg |
| 2,608,105 | A | | 8/1952 | Popp |
| 4,241,249 | A | | 12/1980 | Chundelak, Jr. |
| 4,766,272 | A | | 8/1988 | Guzzon |
| 5,993,159 | A | | 11/1999 | Mack |

* cited by examiner

*Primary Examiner*—Sandra O'Shea
*Assistant Examiner*—Hargobind S. Sawhney
(74) *Attorney, Agent, or Firm*—Nelson Mullins Riley & Scarborough

(57) ABSTRACT

A lamp comprises a light socket supported by a lamp column extending up from a base. The light socket includes a pull cord for operating same. A pull cord guide device is attached to the lamp and includes an extension portion extending laterally from an axis of the lamp column. The extension portion of the pull cord guide device defines a guide hole located adjacent to a distal end thereof. The pull cord extends through the guide hole so as to be spaced apart from the lamp column.

20 Claims, 4 Drawing Sheets

LAMP HAVING PULL CORD GUIDE DEVICE

BACKGROUND OF THE INVENTION

The present invention relates generally to a guide device mounted on the column of a lamp operated by a pull cord to guide the pull cord away from the lamp column for ease of operation.

Floor and wall-mounted lamps often operate with a light socket that uses a pull cord mechanism to operate the light socket's internal switch. Often, the pull cord may be made of a flexible string of balls commonly referred to as a pull chain. In such an arrangement, the pull chain exits the light socket and hangs vertically against the lower portion of the light socket and lamp column. Pulling downward on the pull chain toggles the switch so as to operate the light bulb.

An inherent problem with this typical arrangement is that the pull chain necessarily lies against the light socket and lamp column. As such, the pull chain is not as readily accessible as it would be if it were hanging at a slight distance from the light socket and lamp column. In addition, with the pull chain lying against the light socket and lamp column, operation of the lamp may involve rubbing the pull chain against the light socket and lamp column. This friction may result in unwanted chafing of the finish on the light socket and lamp column.

SUMMARY OF THE INVENTION

The present invention recognizes and addresses the disadvantages discussed above and others of prior art constructions and methods. Accordingly, it is an object of the present invention to provide a device to horizontally separate the pull chain from the light socket and lamp column of a lamp.

It is a further object of the present invention to ease the operation of the light socket by mechanically converting more of the downward force applied to the pull chain into a horizontal force at the light socket.

It is an additional object of the present invention to improve the operation of the light socket by reducing friction between the pull chain and the light socket and lamp column.

Some of these objects are achieved by a lamp comprising a lamp column extending from a base. A light socket including a pull cord for operating same is supported by the lamp column. A pull cord guide device is attached to the lamp and includes an extension portion extending laterally from an axis of the lamp column. The extension portion of the pull cord guide device defines a guide hole located adjacent to a distal end thereof. The pull cord extends through the guide hole so as to be spaced apart from the lamp column. Often, it will be desirable to construct the pull cord guide device as a unitary body.

In some exemplary embodiments, the pull cord guide device comprises an attachment collar defined by a top side, a bottom side, and an edge. An extension portion emanates from the edge of the attachment collar. A cylindrical guide hole is defined by the extension portion adjacent the distal end thereof. The cylindrical guide hole traverses the extension portion obliquely so as to facilitate movement of the pull cord therethrough.

Often, it will be desirable to configure the attachment collar so as to define a concentric passageway traversing the attachment collar. In addition, the attachment collar may define a concentric indentation on the bottom side thereof. Often, it will be desirable to configure the extension portion as a generally flat member having a downward bend at an intermediate location thereof. In some cases, a perimeter of the extension portion may be characterized by decorative filigree.

Other objects of the invention are achieved by a device for use with a lamp to maintain a pull cord of a light socket thereof in spaced apart relation. The device comprises an attachment collar defined by a top side, a bottom side, and an edge. An extension portion emanates from the edge of the attachment collar. A cylindrical guide hole is defined by the extension portion adjacent the distal end thereof.

Still further objects of the present invention are achieved by a lamp comprising a support structure having a threaded stud. A light socket including a pull cord for operating same is threadedly attached to the threaded stud on the support structure. A pull cord guide device is maintained on the threaded stud between the light socket and the support structure. The pull cord guide device serves to maintain the pull cord in spaced apart relation.

Other objectives, features and aspects of the present invention are provided by various combinations and subcombinations of the disclosed elements, as well as methods of practicing same, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
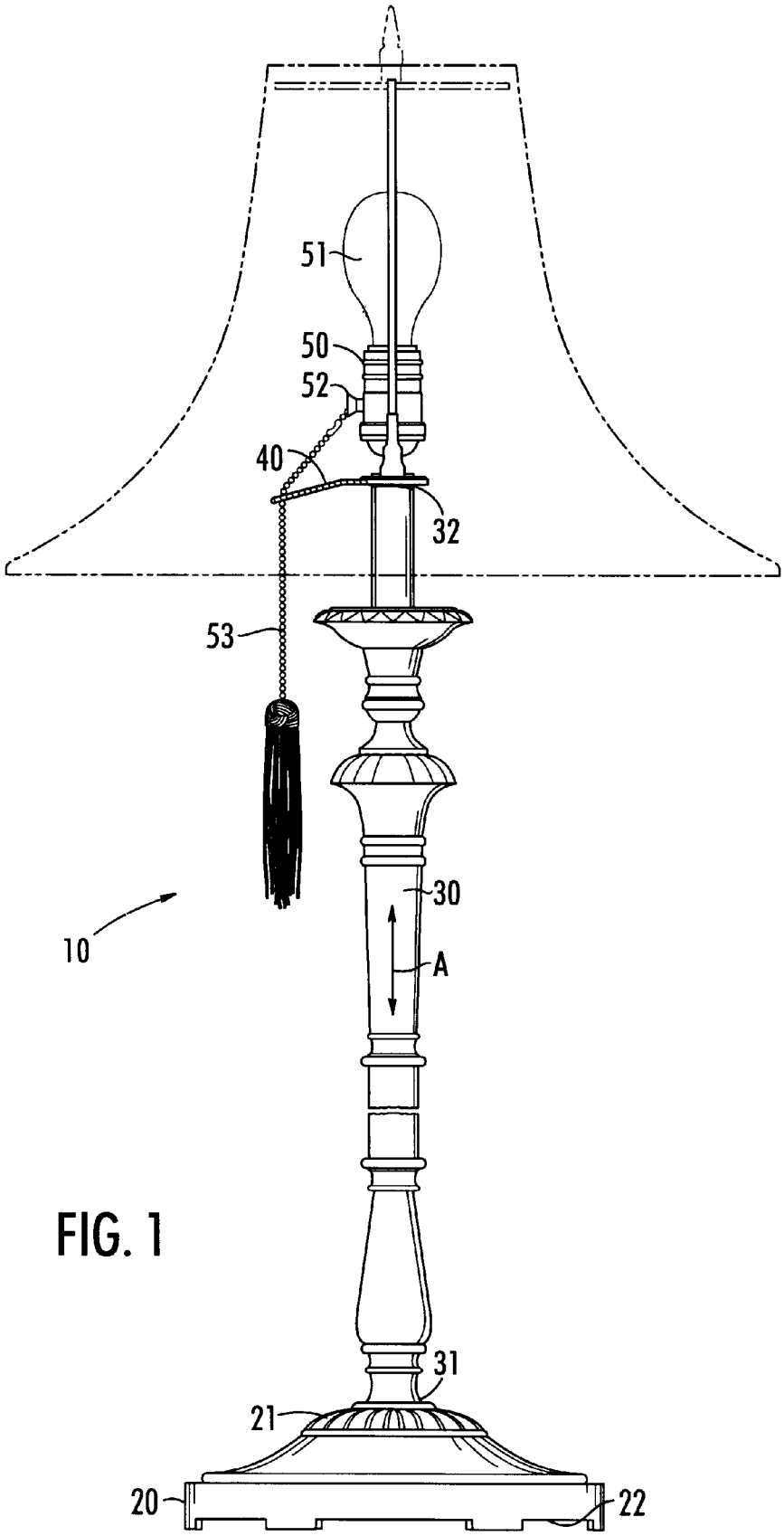
FIG. 1 is a side elevational view of a lamp including a pull cord guide device constructed in accordance with the present invention.

Repeat use of reference characters in the present specification and drawings is intended to represent the same or analogous features or elements of embodiments of the invention.

DETAILED DESCRIPTION OF PREFERRED EMBODIMENTS

It is to be understood by one of ordinary skill in the art that the present discussion is a description of exemplary embodiments only and is not intended to limit the broader aspects of the present invention even though broader aspects are embodied in the present invention.

FIG. 1 illustrates a lamp 10 including a base 20, a lamp column 30, a pull cord guide device 40, and a light socket 50. The top side 21 of base 20 is attached at 31 to the bottom of lamp column 30. Generally, the inside of lamp column 30 will be hollow to allow an electrical cord to pass unseen from the light socket 50, through the lamp column 30, and out the bottom of the base 20 to a source of power.

The bottom side 22 of base 20 provides a stable contact upon which the lamp will rest. The base 20 can be any suitable combination of dimension and weight sufficient to provide a stable platform for the remainder of the lamp. Although FIG. 1 illustrates the preferred embodiment of a floor or table-resting lamp, it will be appreciated that teachings of the present invention are also applicable to wall-mounted lamps.

Figure 2:
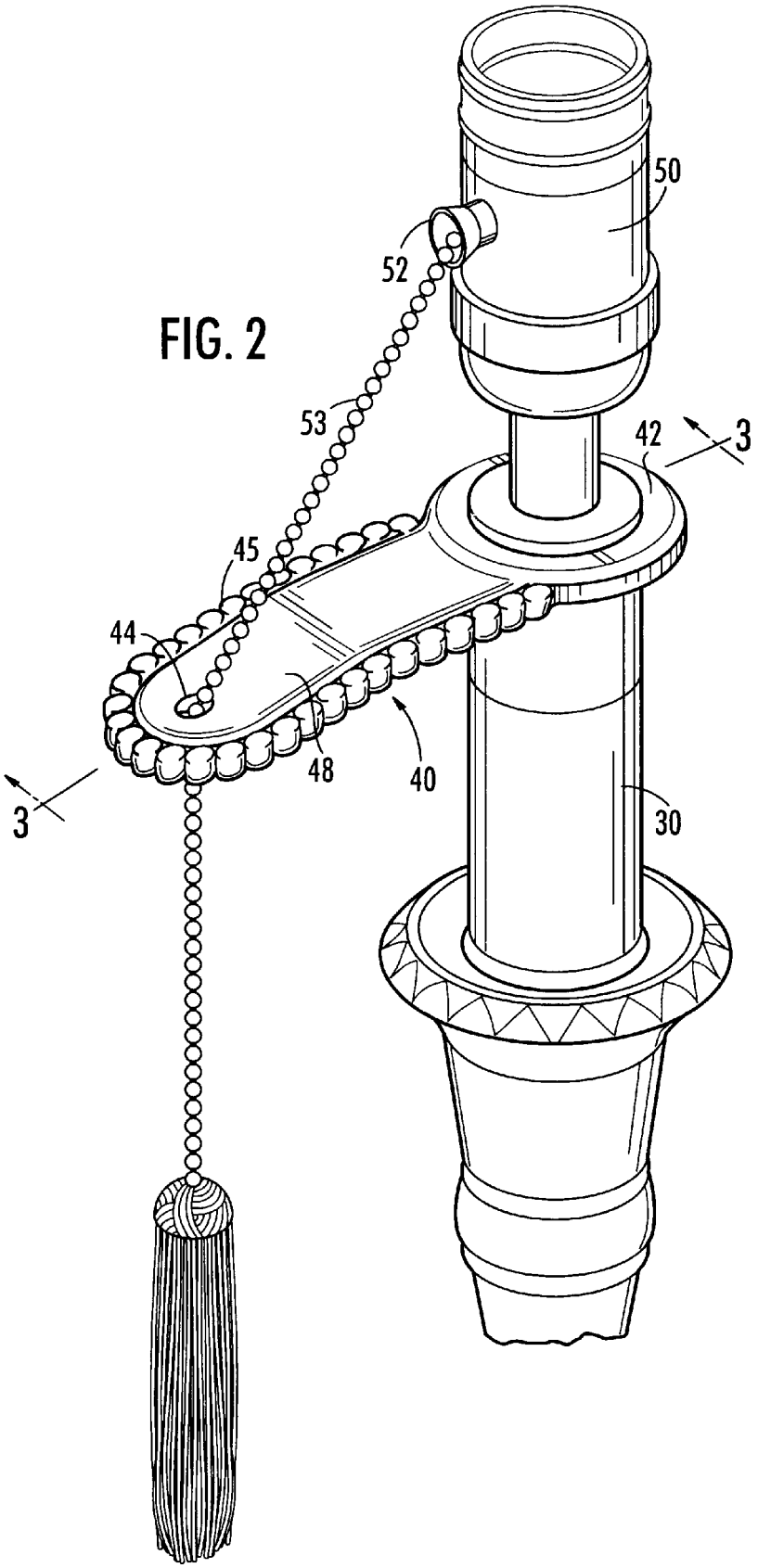
FIG. 2 is an enlarged perspective view of the pull cord guide device of FIG. 1 installed on the lamp.
Figure 3:
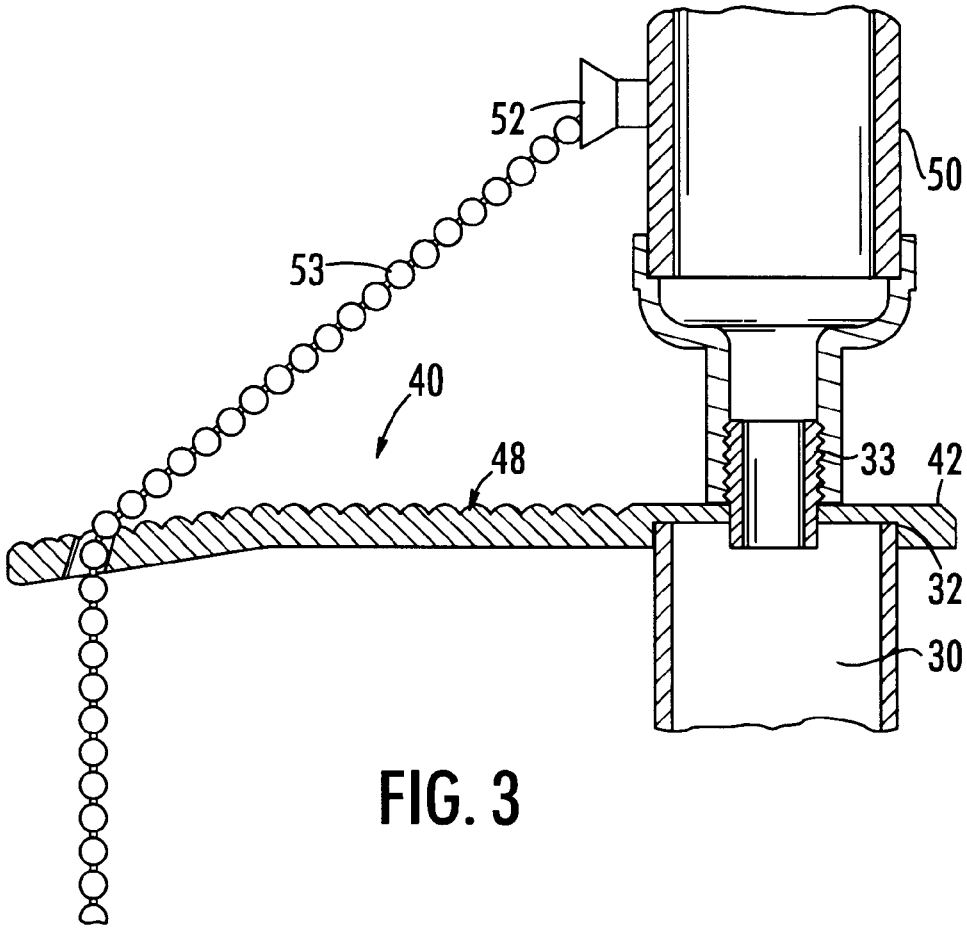
FIG. 3 is cross-section view of the pull cord guide device taken along line 3—3 of FIG. 2.
Figure 4:
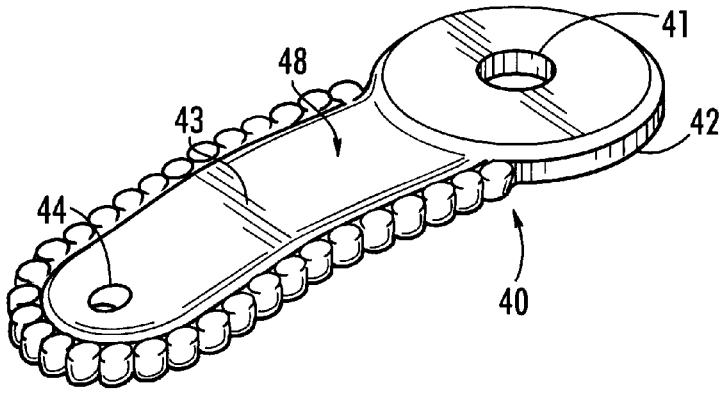
FIG. 4 is a perspective view of the pull cord guide device removed from the lamp.
Figure 5:
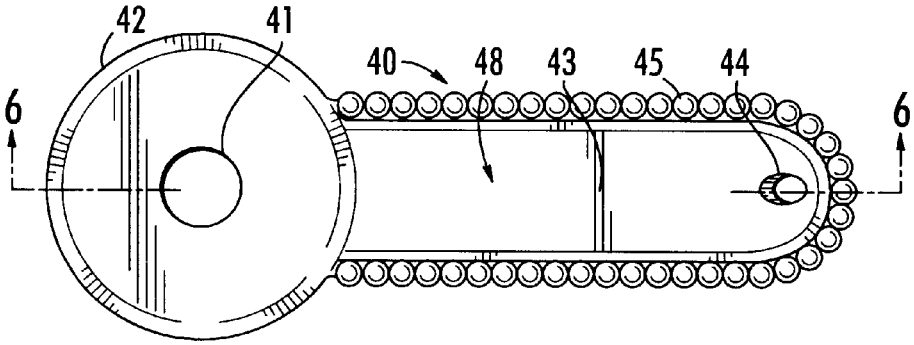
FIG. 5 is a top plan view of the pull cord guide device.

In presently preferred embodiments, pull cord guide device 40 is constructed as a unitary element made of any suitable rigid material that extends the pull chain 53 horizontally from the light socket 50 and lamp column 30. As can be seen most clearly in FIGS. 2 and 3, device 40 attaches to top 32 of lamp column 30 in the vicinity of the light socket 50 by way of an attachment collar. In the preferred embodiment, the attachment collar is depicted as a mounting disc 42 including a concentric passageway 41 through which a threaded stud 33 passes. Light socket 50 is tightened onto threaded stud 33 such that mounting disc 42 will be maintained securely in position.

One skilled in the art will appreciate that the size and shape of the mounting disc 42 and concentric passageway 41 may vary depending on the exigencies of the particular application. For example, the attachment collar may resemble a fork, u-shape, or other similar form in alternate embodiments.

Figure 6:
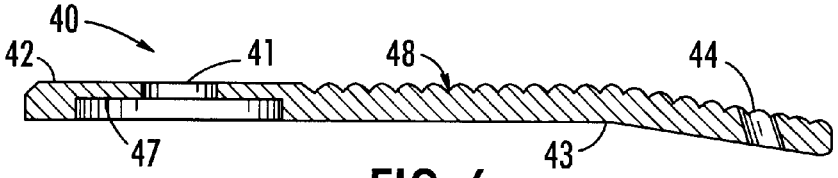
FIG. 6 is a cross-section view of the pull cord guide device taken along line 6—6 of FIG. 5.
Figure 7:
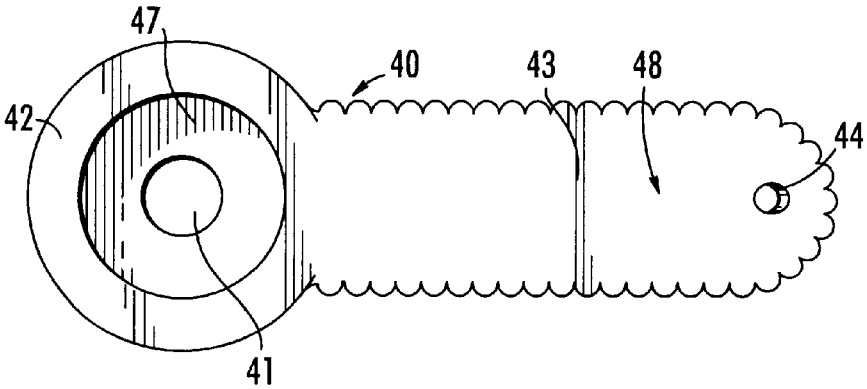
FIG. 7 is a bottom plan view of the pull cord guide device.

Referring to FIGS. 6 and 7, the bottom side of the mounting disc 42 may include a concentric indentation 47 that is larger in radius than the concentric passageway 41. The top of lamp column 30 may be received in this concentric indentation 47 to more securely maintain device 40 in position.

Pull cord guide device 40 includes an extension portion 48 beginning at the mounting disc 42 and extending generally horizontally away from the lamp column 30. Extension portion 48 is generally flat and has a guide hole 44 defined adjacent to its distal end. As shown, guide hole 44 is circular in shape and completely traverses the extension portion 48. Moreover, the axis of guide hole 44 is preferably canted toward the top of lamp column 30 at an oblique angle such that the top of the guide hole 44 is closer to the top of the lamp column 30 than the bottom of guide hole 44. This arrangement is advantageous to more efficiently convert downward force applied to the pull chain into horizontal force at the light socket.

Preferably, the extension portion 48 includes a slight bend 43 downward at an intermediate location 43 between the mounting disc 42 and the guide hole 44. For example, the slight bend downward may be approximately 10 degrees from horizontal. In addition, the perimeter of the extension portion may be ordained with ornamental balls 45 or some other decorative filigree.

As shown in FIG. 1, light socket 50 holds one or more light bulbs 51. The light socket 50 further includes a toggle switch mechanism, widely available and known in the prior art, to operate the lamp. A pull cord 53 operates the toggle mechanism by changing the operating status of the light bulb 51 with each successive pull on the cord.

As illustrated in the preferred embodiment, the pull cord 53 commonly consists of a flexible string of balls called a pull chain. Pull cord 53 exits the toggle mechanism through an operating collar 52 and passes through the guide hole 44 adjacent to the distal end of extension portion 48. After passing through the guide hole 44, the pull chain 53 hangs vertically, separated from the lamp column 30 by the horizontal distance from the mounting disc 42 to the guide hole 44. As a result of this configuration, the user can easily locate and operate the pull chain 53 with a downward motion.

It can thus be seen that the present invention provides a pull cord guide device in furtherance of the noted objects. While preferred embodiments of the invention have been shown and described, modifications and variations may be made thereto by those of ordinary skill in the art without departing from the spirit and scope of the present invention, which is more particularly set forth in the appended claims. In addition, aspects of the various embodiments may be interchanged both in whole or in part. Furthermore, those of ordinary skill in the art will appreciate that the foregoing description is by way of example only, and is not intended to be the exclusive embodiment of the invention further described in such appended claims.

What is claimed is:

1. A lamp comprising:

a base;

a lamp column extending from said base;

a light socket supported by said lamp column, said light socket including a pull cord for operating same;

a pull cord guide device attached to said lamp, said pull cord guide device including:

an attachment collar defined by a top side, a bottom side, and an edge;

a finger-like and an elongated extension portion having a proximal end and a distal end, said proximal end of said extension portion emanating from said edge of said attachment collar so as to extend laterally from an axis of said lamp column; and said extension portion of said pull cord guide device defining a guide hole located adjacent to a distal end thereof, said pull cord extending through said guide hole so as to be spaced apart from said lamp column.

2. A lamp as set forth in claim 1, wherein said guide hole is a cylindrical guide hole defined by said extension portion adjacent said distal end of said extension portion, wherein said cylindrical guide hole traverses said extension portion at a slant with respect thereto so as to facilitate movement of said pull cord therethrough.

3. A lamp as set forth in claim 2, wherein the attachment collar defines a concentric passageway traversing the attachment collar.

4. A lamp as set forth in claim 2, wherein the attachment collar defines a concentric indentation on the bottom side thereof.

5. A lamp as set forth in claim 2, wherein a perimeter of said extension portion is characterized by decorative filigree.

6. A lamp as set forth in claim 2, wherein said pull cord guide device is constructed as a unitary body.

7. A lamp comprising:

a base;

a lamp column extending from said base;

a light socket supported by said lamp column, said light socket including a pull cord for operating same;

a pull cord guide device attached to said lamp, said pull cord guide device including:

i. an attachment collar defined by a top side, a bottom side, and an edge;

ii. an extension portion emanating from said edge of said attachment collar, said extension portion extending laterally from an axis of said lamp column and being configured as a generally flat member having a downward bend at an intermediate location thereof; and iii. a cylindrical guide hole defined by said extension portion adjacent to distal end of said extension portion, said pull cord extending through said guide hole so as to be spaced apart from said lamp column, wherein said cylindrical guide hole traverses said extension portion obliquely so as to facilitate movement of said pull cord therethrough.

8. A device for use with a lamp to maintain a pull cord of a light socket thereof in spaced apart relation, said device comprising:

an attachment collar defined by a top side, a bottom side, and an edge;

an extension portion emanating from said edge of said attachment collar, said extension portion being configured as a generally flat member having a downward bend at an intermediate location thereof; and a cylindrical guide hole defined by said extension portion adjacent a distal end thereof.

9. A device as set forth in claim 8, wherein said cylindrical guide hole traverses said extension portion obliquely so as to facilitate movement of said pull cord therethrough.

10. A device as set forth in claim 8, wherein said attachment collar defines a concentric passageway traversing said attachment collar.

11. A device as set forth in claim 8, wherein a perimeter of said extension portion is characterized by decorative filigree.

12. A device as set forth in claim 8, wherein said device is constructed as a unitary body.

13. A device for use with a lamp to maintain a pull cord of a light socket thereof in spaced apart relation, said device comprising:

an attachment collar defined by a top side, a bottom side, an edge and a concentric passageway traversing therethrough, said attachment collar further defining a concentric indentation on said bottom side thereof;

an extension portion emanating from said edge of said attachment collar;

a cylindrical guide hole defined by said extension portion adjacent a distal end thereof.

14. A lamp comprising:

a support structure having a threaded stud;

a light socket, threadedly attached to said threaded stud on said support structure, wherein said light socket includes a pull cord for operating same;

a pull cord guide device constructed as a unitary body including an attachment collar from which an elongate extension collar extends, said attachment portion defining a concentric passageway for receipt of said threaded stud therein the attachment collar defines a concentric indentation on a side thereof;

said attachment collar of said pull cord guide device being maintained on said threaded stud between said light socket and said support structure, said pull cord guide device maintaining said pull cord in spaced apart relation.

15. A lamp as in claim 14, wherein:

said attachment collar is defined by a top side, a bottom side, and an edge;

said extension portion emanates from said edge of said attachment collar;

a cylindrical guide hole is defined by said extension portion adjacent a distal end thereof.

16. A lamp as set forth in claim 15, wherein said cylindrical guide hole traverses said extension portion at a slant with respect thereto so as to facilitate movement of said pull cord therethrough.

17. A lamp as set forth in claim 15, wherein the attachment collar defines a concentric passageway traversing the attachment collar.

18. A lamp as set forth in claim 14, wherein the attachment collar defines said concentric indentation on the bottom side thereof.

19. A lamp as set forth in claim 15, wherein a perimeter of said extension portion is characterized by decorative filigree.

20. A lamp comprising:

a support structure having a threaded stud;

a light socket, threadedly attached to said threaded stud on said support structure, wherein said light socket includes a pull cord for operating same;

a pull cord guide device maintained on said threaded stud between said light socket and said support structure, said pull cord guide device maintaining said pull cord in spaced apart relation;

said pull cord guide device including:

i. an attachment collar defined by a top side, a bottom side, and an edge;

ii. an extension portion emanating from said edge of said attachment collar, the extension portion being configured as a generally flat member having a downward bend at an intermediate location thereof;

iii. a cylindrical guide hole defined by said extension portion adjacent a distal end thereof.

* * * * *